US006389871B1

(12) United States Patent
Yamamoto et al.

(10) Patent No.: US 6,389,871 B1
(45) Date of Patent: May 21, 2002

(54) SLAB SIZING PRESS AND SIZING PRESS LOAD TRANSMISSION METHOD

(75) Inventors: Akihiro Yamamoto; Shigetoshi Kondoh, both of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/564,579

(22) Filed: May 5, 2000

(30) Foreign Application Priority Data

May 10, 1999 (JP) ..... 11-128880

(51) Int. Cl.[7] ..... B21J 9/18

(52) U.S. Cl. ..... 72/452.5; 72/206; 72/407; 72/450; 72/453.03

(58) Field of Search ..... 72/184, 206, 406, 72/450, 452.5, 453.03, 407

(56) References Cited

U.S. PATENT DOCUMENTS 4,852,383 A * 8/1989 Nikaido et al. ..... 72/407
5,901,602 A * 5/1999 Donini ..... 72/453.03

FOREIGN PATENT DOCUMENTS

| | | | |
|---|---|---|---|
| JP | 2-50807 | | 2/1990 |
| JP | 4-37403 | * | 2/1992 |
| JP | 5-123701 | | 5/1993 |
| JP | 11-57814 | | 12/1999 |

* cited by examiner

*Primary Examiner*—David Jones
(74) *Attorney, Agent, or Firm*—Crowell & Moring LLP

(57) ABSTRACT

A slab sizing press, of which the mechanism is stable and the construction is simple and the maintainability is excellent, comprises a crank shaft, an arm rotatably mounted on the crank shaft, an outer block transmitting a load to and from the arm, an inner block provided so that a distance from the outer block is adjustable and a die is mounted on the inner block. A first rolling element, for example, a flat plate is provided on one side of a load transmission portion between the arm and the outer block, a second rolling element, for example, a rocker plate is provided on the other side of the load transmission portion, and the load is transmitted by rolling contact between them. As means for stopping slip of the rolling contact surfaces of the rolling element, sector gears meshing with each other are provided on both sides of the arm and outer block, and at least one of the gears is movably supported by a pin.

17 Claims, 9 Drawing Sheets

SLAB SIZING PRESS AND SIZING PRESS LOAD TRANSMISSION METHOD

BACKGROUND OF THE INVENTION

The present invention relates to a width reducing installation of hot slabs and, more particularly, to a slab sizing press which reduces the width of a slab by pressing the slab side surfaces by reciprocatively driving caused by rotation of opposite crank shafts.

In a conventional slab sizing press, a method of connecting a crank shaft and an outer block by connecting rods each having bearings at both ends thereof (JP B 2-50807, FIG. 3) or a method of connecting them by connecting rods each having a bearing on the crank shaft side and formed in a male-female spherical surface (pitman) on the outer block side (JP A 5-123701, FIG. 4) is realized as a means for transmitting reciprocatively driving caused by rotation of the crank shaft to the outer block.

As required commonly to industrial machinery, it is required also for a slab sizing press installation to be low in installation cost, simple in construction and excellent in maintainability. In the slab sizing press, slab side surfaces are pressed by using dies each having a parallel portion and a tapered portion to obtain a desired slab width. In this case, in order to prevent buckling or to control flatness shape of the slab, leading and trailing ends of the slab are preformed and the slab is reversely pressed depending on forward and backward equipments.

The center of a press load in the slab sizing press changes according to such a die shape and various operation modes and, particularly, a large change in an entry-delivery direction becomes a cause of destroying the The conventional slab sizing press disclosed in the JP B 2-50807 is provided with bearings at both ends of 2 connecting rods arranged on each side of entry and delivery sides, that is, 4 connecting rods in total. The slab sizing press has a high mechanical stability to a change of the press load center, however, a equipment cost is high because the construction is complicate and maintainability therefor is bad.

Further, the slab sizing press disclosed in the JP A 5-123701 is provided with one connecting rod on each side, that is, 2 connecting rods in total, each connecting rod is formed in a male-female spherical surface (pitman) on the outer block side and a crank mechanism is relatively simple. However, since it is connected by one connecting rod, the mechanism such as the press load center changes is low in stability, and angular moment due to deviation of the load center occurs on the outer block. Therefore, it is necessary to provide a guide mechanism which can resist the angular moment on a peripheral portion of the outer block, and the maintainability of the guide mechanism is bad. Further, the male-female spherical surface portions are in slipping contact with each other and wear, so that the maintainability also is bad from this point of view.

Because of the presence of the above-mentioned problems, there is desired a slab sizing press which has both a highly stable mechanism and a simple construction, and which is excellent in maintainability.

SUMMARY OF THE INVENTION

An object of the present invention is to provide a slab sizing press which is mechanically stable, simple in construction and excellent in maintainability.

(1) In order to attain the above-mentioned object, the present invention comprises an eccentric crank shaft, an arm rotatably mounted on the eccentric crank shaft, a first block transmitting a load between the arm, a second block mounted so that a distance from the first block is adjustable and a die mounted on the second block, has a first rolling element provided on one side of a load transmission portion between the arm and the first block and a second rolling element provided on the other side of the load transmission portion, wherein a load is transmitted by rolling contact between the first rolling element and second rolling element, and gears, as means for preventing the first and second rolling elements from slipping on rolling contact surfaces, provided on the sides of the arm and the first block so as to mesh with each other, and movably supports at least one of the gears.

By providing the first rolling element on one side of the load transmission portion between the arm and the first block to transmit a load by rolling contact therebetween, the facility construction is made simple and the length of the facility can be reduced, without necessity of conventional connecting rods.

Further, by providing the gears which mesh with each other on both the arm side and the first block side as a slip prevention means of the rolling contact surfaces of the first and second rolling elements, it is possible to keep a load transmission course constant and to obtain a high mechanical stability. At the same time, it is possible to suppress the wear of the rolling contact surfaces and to improve the maintainability of the equipment.

The above-mentioned matter is based on the technical idea of the invention proposed in JP A 9-299914 which is an earlier Japanese application of the corresponding Japanese application.

In the present invention, in addition to the above, at least one of the gears meshed with each other is movably supported, whereby even if elastic deformation occurs on the rolling surfaces of the first and second rolling elements, the gears are not pressed on each other, so that any wedge effect does not occur. Therefore, it is possible to avoid an excessive surface pressure or bending stress, acting on the tooth surfaces, to make the gear life long, and to further improve the maintainability of the equipment.

(2) In the above-mentioned item (1), preferably, a stopper for limiting a movement range of the gear and a means for urging the gear to press on the stopper are provided as a means for holding the movably supported gear at a desired position.

By pressing the movably supported gear on the stopper with force larger than the inertia acting on the gear by reciprocative driving, it is possible to exclude an influence of the inertia, so that a relative position of the first and second rolling elements can be held with high precision and it is possible to make the life further long.

(3) Further, in the above-mentioned item (2), preferably, a third rolling element moving integrated with the movably supported gear is provided as means for maintaining a distance between the meshing gears, the third rolling element is made in the same shape as a rolling surface of the rolling element on the side of the movably supported gear, and contacted with the rolling element on the side of the other gear.

Thereby, a distance between the meshed gears can be kept constant, so that a desired backlash can be held, the wedge effect and sticking of tooth faces can be suppressed and further long life of the gears can be realized.

BRIEF DESCRIPTION OF THE INVENTION

Figure 1:
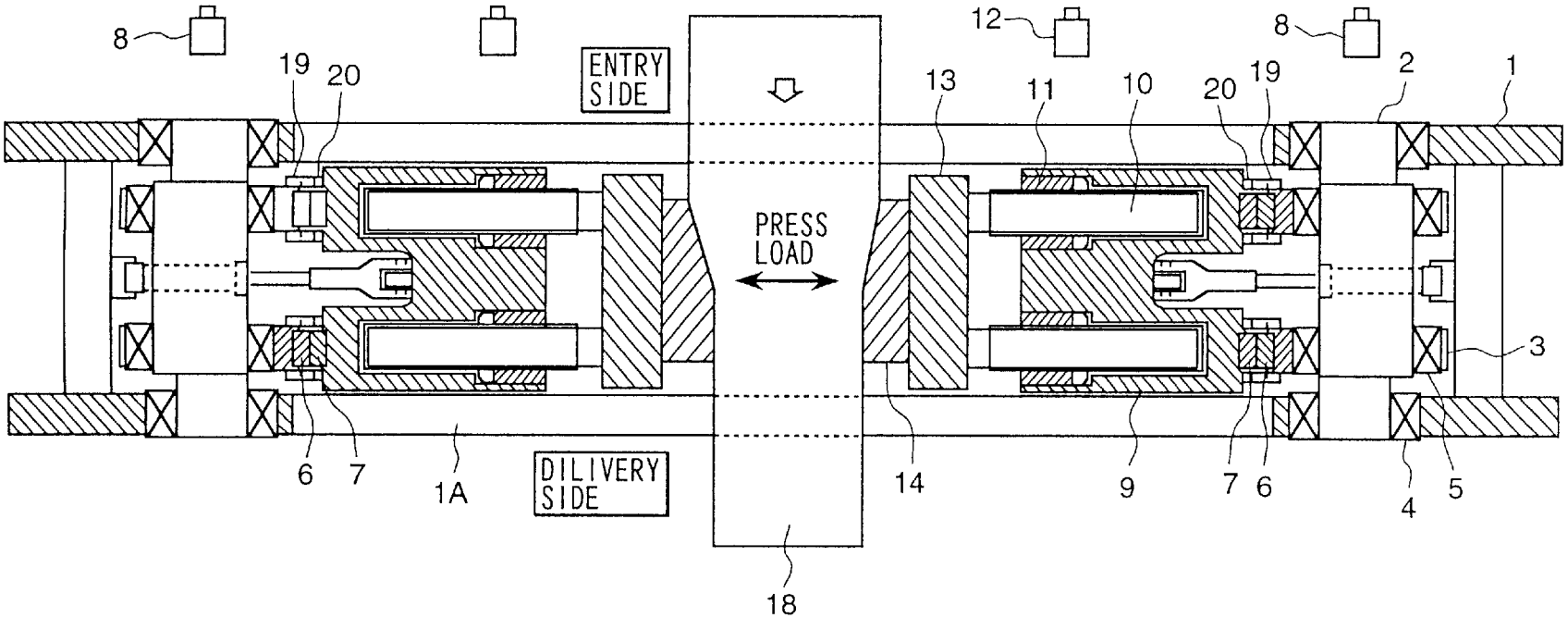
FIG. 1 is a plan view of a slab sizing press of a first embodiment of the present invention.
Figure 3A:
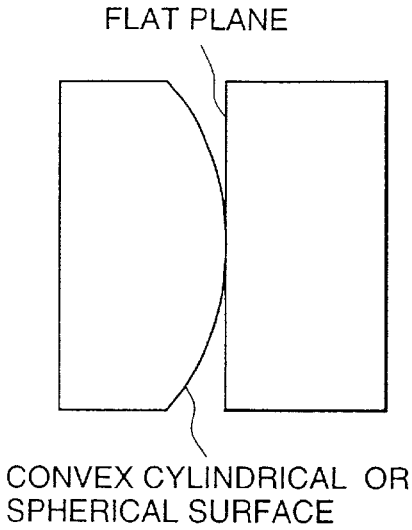
Figure 3B:
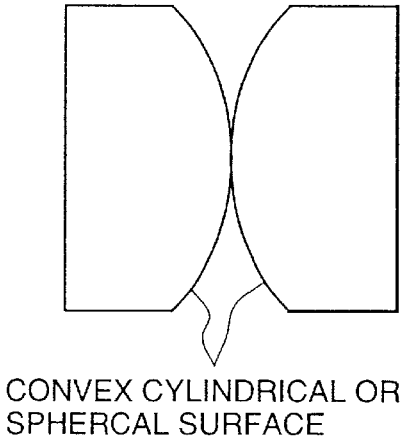
Figure 3C:
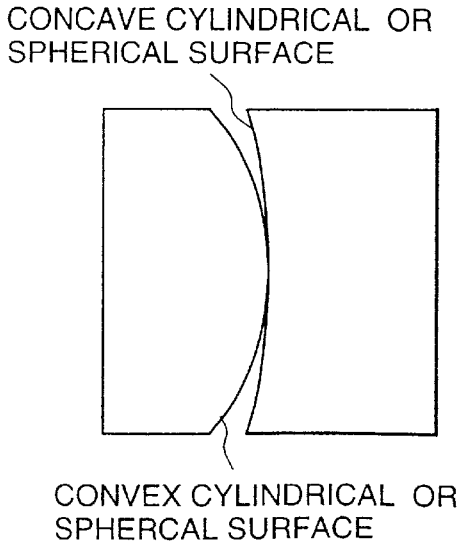
Figure 4:
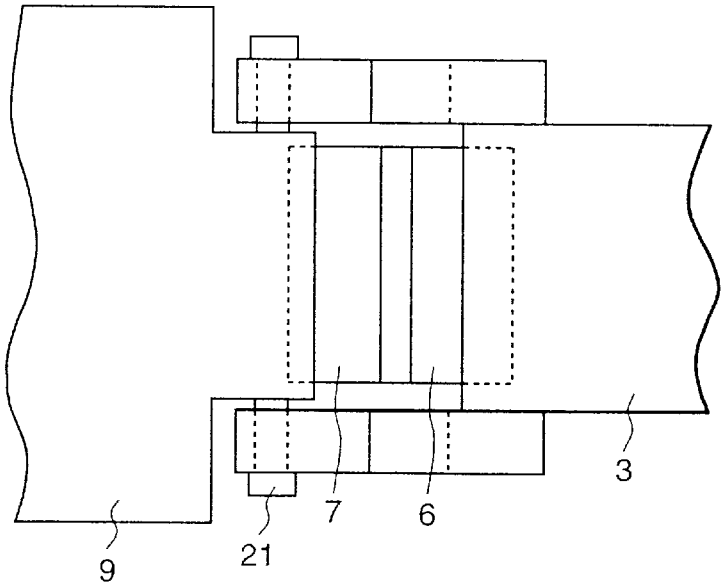
Figure 5:
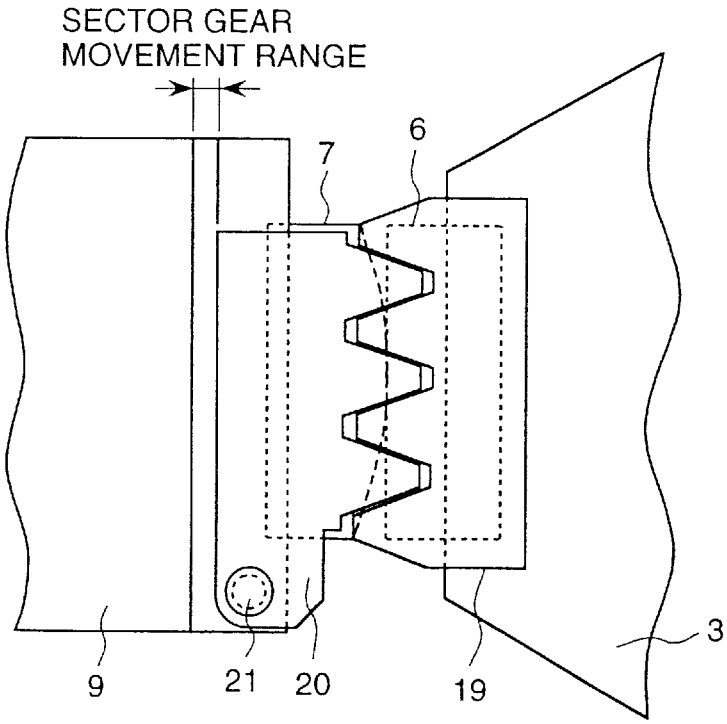
Figure 6:
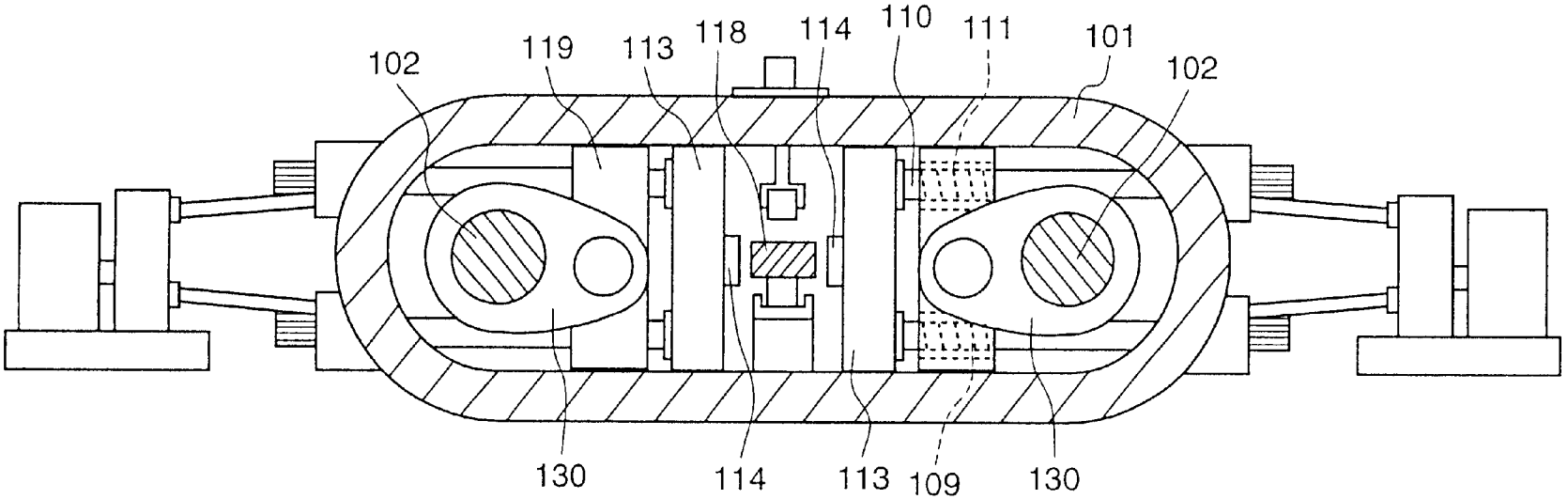
FIG. 6 (PRIOR ART)
Figure 7A:
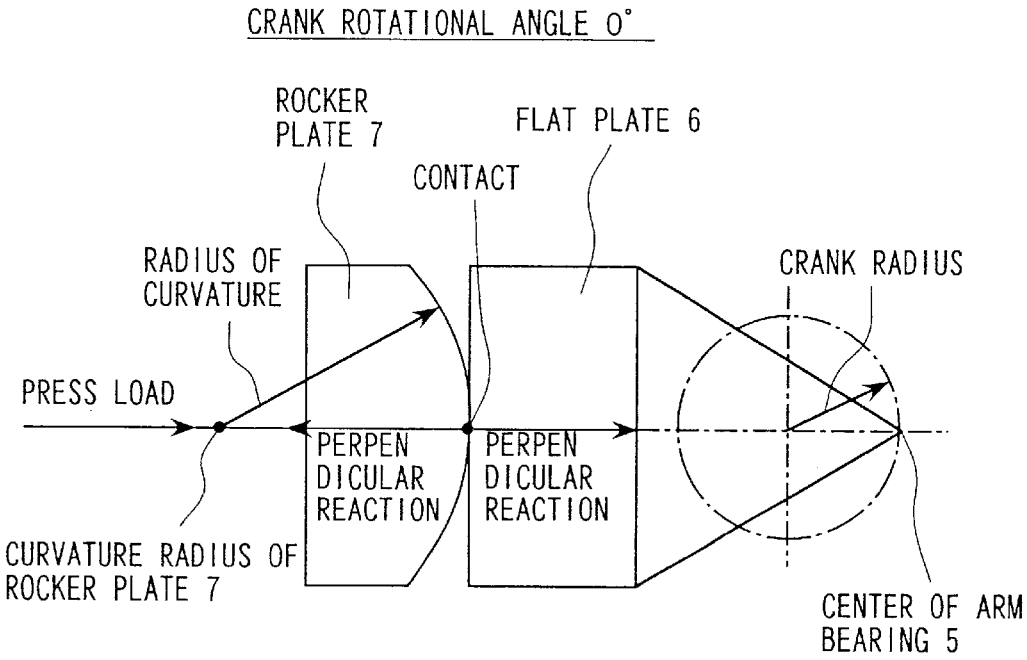
Figure 7B:
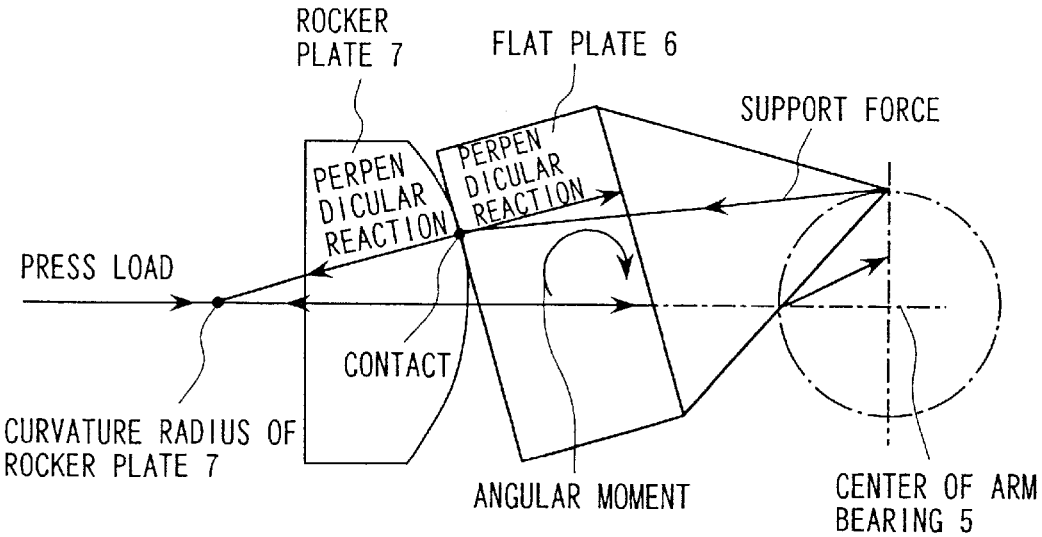
Figure 8:
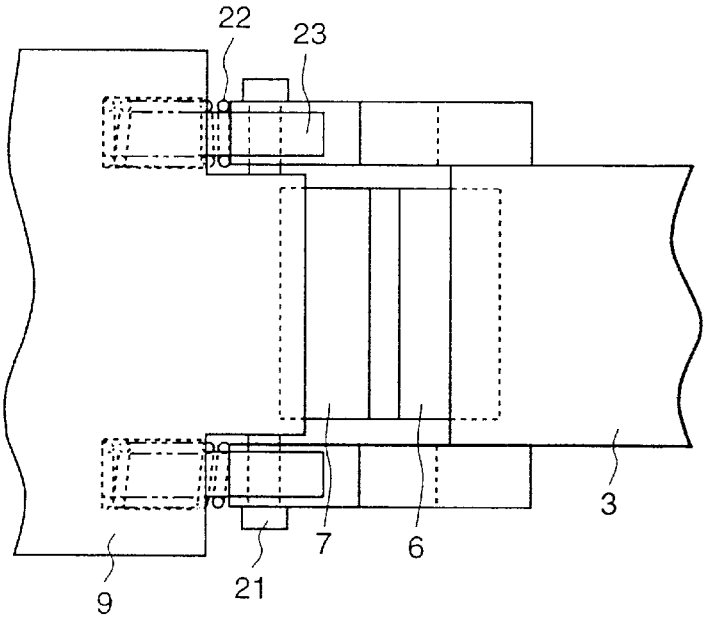
Figure 9:
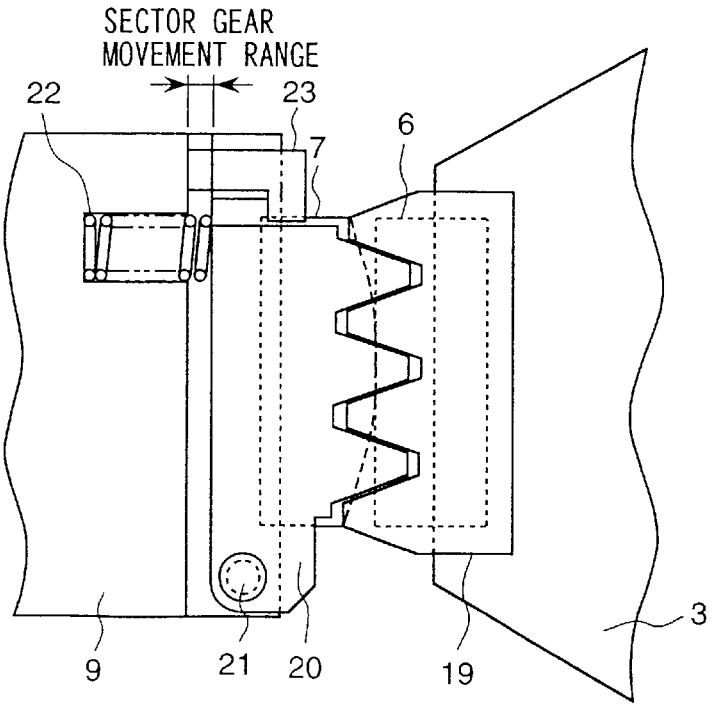
Figure 10:
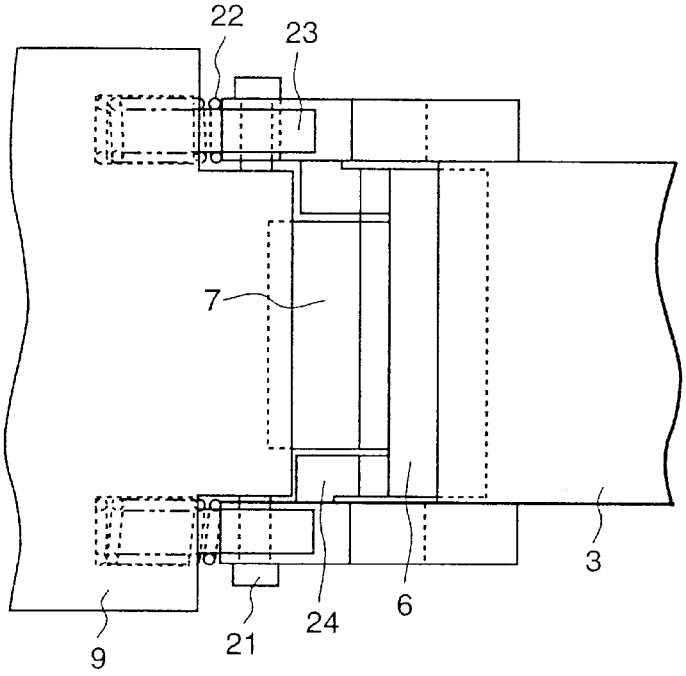
Figure 11:
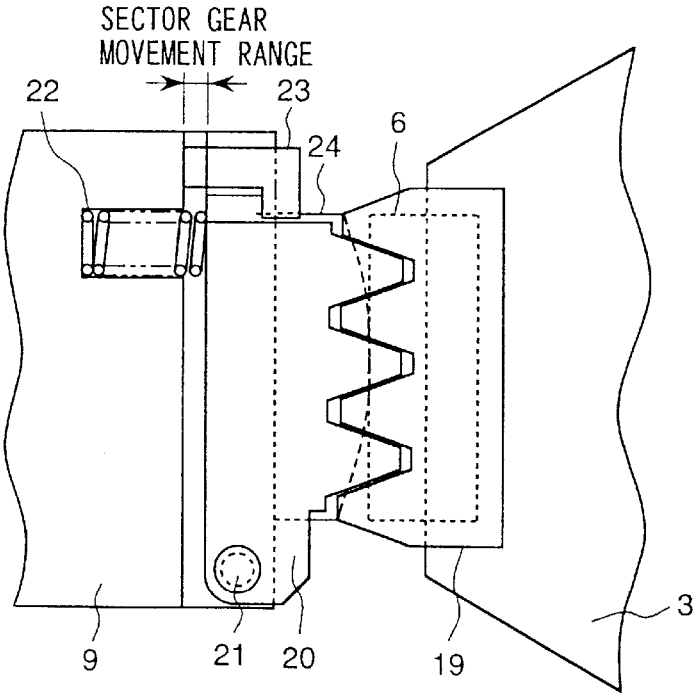
Figure 12:
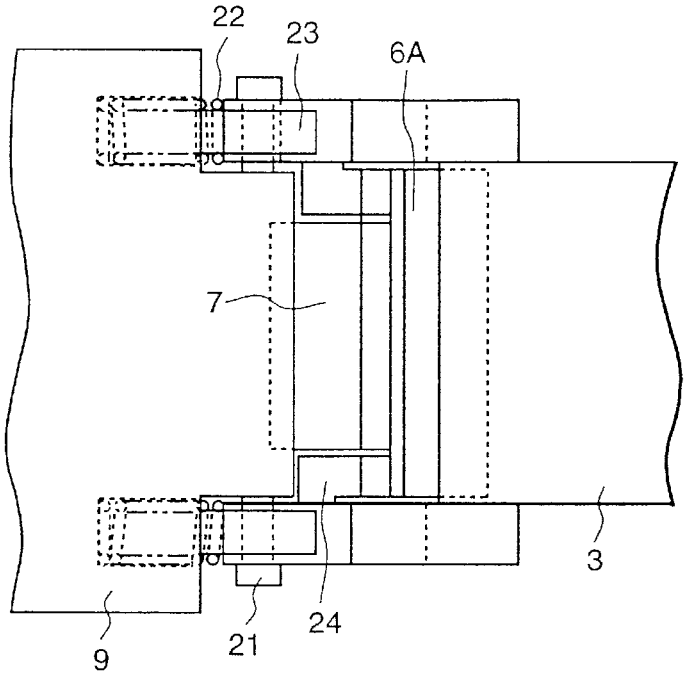
Figure 13:
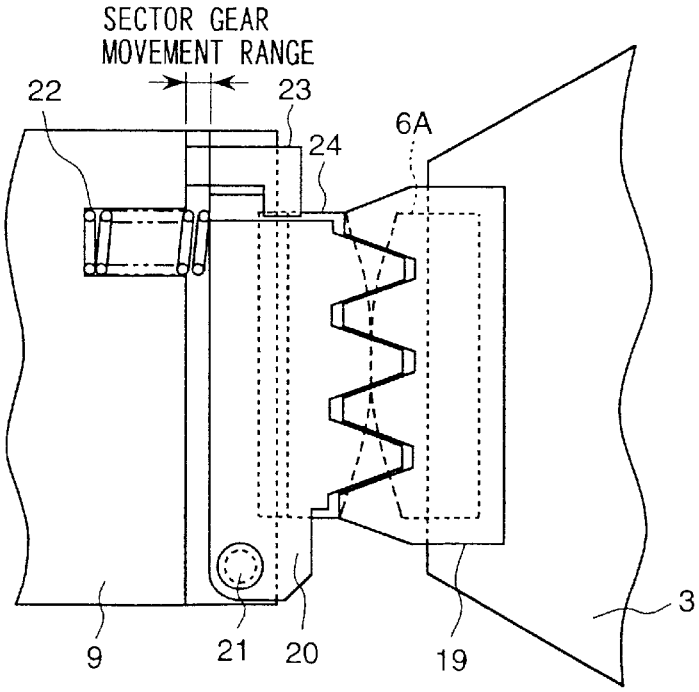

FIGS. 3A, 3B and 3C each are a view showing a combination of a rolling surface shape of a rolling element on an arm side and a rolling surface shape of a rolling element on an outer block side according to the present invention;

FIG. 4 is an enlarged plan view of the rolling element portion of the slab sizing press shown in FIG. 1;

FIG. 5 is an enlarged front view of the rolling element portion of the slab sizing press shown in FIG. 1;

FIG. 6 is a front view of a conventional slab sizing press disclosed in JP A 2-50807, taken as an example for comparison;

FIGS. 7A and 7B each are a view showing a press load transmission state, FIG. 7A shows the case where a perpendicular reaction received by a flat plate and a support force received from a bearing for an arm have the same orientation, and FIG. 7B shows the case where the perpendicular reaction received by the flat plate and the support force received from the arm bearing have different orientations;

FIG. 8 is an enlarged plan view of a rolling element portion of a slab sizing press of a second embodiment of the present invention;

FIG. 9 is an enlarged front view of the rolling element portion of the slab sizing press shown in FIG. 8;

FIG. 10 is an enlarged plan view of a rolling element portion of a slab sizing press of a third embodiment of the present invention;

FIG. 11 is an enlarged front view of the rolling element portion of the slab sizing press shown in FIG. 10;

FIG. 12 is an enlarged plan view of a rolling element portion of a slab sizing press of a fourth embodiment of the present invention; and FIG. 13 is an enlarged front view of the rolling element portion of the slab sizing press shown in FIG. 12;

DESCRIPTION OF EMBODIMENTS OF THE INVENTION

An embodiment of the present invention will be described hereunder, referring to FIGS. 1–7. FIG. 1 is a plan view of a slab sizing press of a first embodiment of the present invention, and FIG. 2 is a front view of the slab sizing press.

The slab sizing press comprises mainly a slab width reducing means, a slab width adjusting means and a slab transferring means. Hereunder, the slab width reducing means and the slab width adjusting means are mainly explained.

Figure 2:
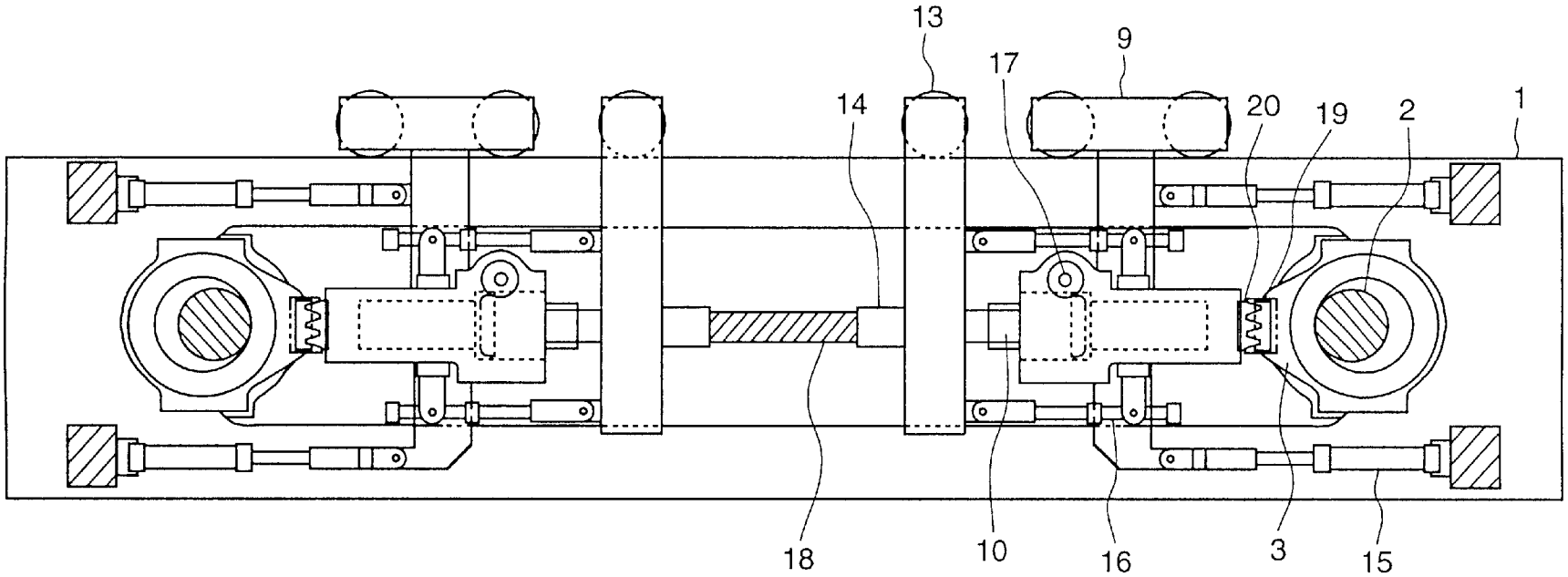
FIG. 2 is a front view of the slab sizing press shown in FIG. 1.

In FIG. 1 and FIG. 2, slab width reduction by vibrating a pair of dies 14 in the width direction of a slab 18 is effected by rotation of crank shafts 2 of eccentric crank shafts each provided at positions on width sides of the slab 18 so as to oppose each other. The crank shafts 2 are rotatably supported by bearings 4 for crank shaft positioned at both ends of a window 1A of a housing 1, and rotated by driving motors 8 for crank shaft. Two arms 3 spaced from each other in the entry and delivery direction (a slab transfer direction) are rotatably mounted on each of the crank shafts 2 through bearings 5 for arm.

Further, between each die 14 and each crank shaft 2 mounting thereon the two arms 3, an outer block 9 and an inner block 13 are provided, which are distance-adjustably mounted through screws 10 and nuts 11.

In the present embodiment, a flat plate 6 as a first rolling element is provided at an end of each arm 3, and the outer block 9 is provided with a rocker plates 7 as second rolling elements each of which contacts with the first rolling element (flat plate 6). By rolling contact of the flat plate 6 and the rocker plate 7, it is possible to transmit a press load generated by width reduction of the slab 18 from the outer block 9 to the arms 3.

Further, a sector gear 19 provided on the arm 3 side and a sector gear 20 provided on the side of the outer block 9 form means for slip prevention of contacting surfaces between the flat plate 6 and the rocker plate 7. The sector gears 19, 20 each are provided as a pair on both sides of the flat plate 6 and the rocker plate 7 so as to sandwich the flat plate 6 and the rocker plate 7. A pitch line of each of the sector gears 19, 20 has the same shape as the rolling surface of each of the flat plate 6 and the rocker plate 7 which are the rolling elements corresponding to the sector gears. That is, the pitch line of the sector gear 19 on the side of the flat plate 19 is a straight line, and the sector gear 19 is a rack. The pitch line of the sector gear 20 on the side of the rocker plate 7 is a pitch circle and the radius of the pitch circle is the same as a radius of the rolling surface of the rocker plate 7. Further, the pitch circle specified in the present specification is defined to include a pitch line of the rack.

In the present embodiment, a combination of the flat plate 6 as a first rolling element and the rocker plate 7 as a second rolling element is an example of a combination of one rolling surface formed as a flat surface and the other rolling surface formed as a convex cylindrical or spherical surface, as shown in FIG. 3A. However, it is not limited to this example. A combination of two rolling elements each of which has a convex cylindrical or spherical surface as shown in FIG. 3B can be taken, or a combination of rolling elements, one rolling surface of which is a concave cylindrical or spherical surface and the other rolling surface is a convex cylindrical or spherical surface as shown in FIG. 3C also can be taken. That is, in the case where a press load is transmitted from the die 14 to the arms 3 through the outer block 9, the transmission is sufficient if it is effected through rolling contact. In any cases, the sector gears 19, 20 have the same pitch circle radius (a pitch line in the case where the rolling element is a flat plate) as radius of the corresponding rolling elements.

Further, the sector gear 20 on the side of the outer block 9 is rotatably mounted on a pin 21 as shown in FIGS. 4 and 5, and supported on the outer block 9 so as to be movable relative to the outer block 9.

Reciprocative driving, which is attained from rotation of the crank shaft 2 and imparted to the outer block 9, is transmitted to the die 14 through the screws 10 and the inner block 13, and the side surfaces of the slab 18 are pressed by the dies 14, thereby to reduce the slab width. That is, the working necessary for reduction is imparted by the reciprocative driving caused by rotation of the crank shaft 2.

Next, adjustment of a slab width to get a slab of desired width is carried out by changing a distance between the inner block 13 and the outer block 9. As a adjustment mechanism of the width, the above-mentioned screw 10 and the nut 11 are provided on the outer block 9. In the present embodiment, 2 sets of the screws 10 and nuts are provided in an entry and delivery direction (in a slab transfer direction), and the apparatus is constructed so that even if the center of a press load changes in the entry and delivery direction, the press load center is positioned between two screws 10. The two screws 10 are arranged so that the height of the axis of each of the two screws 10 is approximately the same as the height of the center of the slab 18, as shown in FIG. 2, and the press load is transmitted to the slab 18 stably in the up down direction.

Further, the screws 10 are axially shifted by rotating the nuts 11 by worm shafts 17, as shown in FIG. 2. The worm shafts 17 each are driven by a motor 12. An end of each of the screws 10 is in contact with a back face of the inner block 13 to transmit the press load. The above-mentioned dies 14, each of which has a parallel portion and a tapered portion, are provided inside the inner block 13.

Further, when gaps or slacks exist in a course in which the press load is transmitted from the die 14 to the housing 1, an impact load occurs, so that an inner block balance cylinder 16 for nullifying a slack between the inner block 13 and the outer block 9 and an outer block balance cylinder 15 for nullifying a slack between the outer block 9 and the housing 1 are provided. The inner block balance cylinder 16 also has a function of nullifying a slack in a driving system of the width adjustment mechanism and the outer block balance cylinder 15 also has a function of nullifying a slack in the driving system of the crank shaft 2.

According to the present embodiment, the following effects can be attained.

1) Since a press load is transmitted by rolling contact of the flat plate 6 and the rocker plate 7, an installation construction is simplified and the length of the installation can be reduced without using any connecting rods as used in the conventional slab sizing press.

2 In the slab sizing press disclosed in JP B 2-5007, two screws 110 and two nuts 111 in an up down direction of each of the entry and delivery sides, that is, four screws 110 and four nuts 111 in total are provided on an outer block 109, the press load caused by slab width reduction is transmitted from a die 114 to screws 110 and nuts 111, further from the screws 110 and the nuts 111 to the outer block 109, connecting rods 130, a crank shaft 102 and a housing 101, in turn. In this case, such a device is taken that ends of the connecting rods 130 are inserted between the upper screws 110 and nuts 111 and the lower crews 110 and nuts 111, in order that the length of the installation does not become long. However, in the case where the ends of the connecting rods 130 are inserted in this manner, in the construction that the screws 110 and nuts 111 are arranged at a central portion of the up down direction, the screws 110 and nuts 111 interface with connecting portions of the connecting rods 130, so that the screws 110 and nuts 111 must be arranged so that the upper screws 110 and nuts 111 and the lower screws 110 and nuts 111 are vertically separated from each other, therefore, it is necessary to provide four screws 110 and four nuts 111.

On the contrary, in the present embodiment, connection by the connecting rods is not taken, but it is so made that a press load is transmitted by rolling contact of the flat plate 6 and the rocker plate 7. Therefore, the screws 10 and nuts 11 can be arranged in a central portion of the up and down direction, the number of the screws 10 and nuts 11 can be 2 at the entry and delivery sides and the width adjustment mechanism can be simplified. Further, it is cleared up that a change of the center of press load is small in the up and down direction and large in the entry and delivery direction (in the slab transfer direction), and the construction can be simplified, without losing the stability, by providing two screws 10 and nuts 11 in the entry and delivery direction.

3) When the flat plate 6 and the rocker plate 7 are brought into rolling-contact, angular moment occurs in the arm 3 because a perpendicular reaction received by the flat plate 6 and a support force received from the bearing 5 for arm have a different orientation from each other. Slip occurs between the rolling contact surfaces of the flat plate 6 and the rocker plate 7 by the angular moment. The slip promotes wear of the rolling contact surfaces of the flat plate 6 and the rocker plate 7 and worsens the maintainability. Further, since a point (a line) at which rolling contact occurs changes and the load transmission course does not become constant, it is not possible to stably transmit the press load.

According to the present embodiment, since it is possible to prevent the rolling contact surfaces of the flat plate 6 and the rocker plate 7 from slipping therebetween by providing the sector gears 19 and 20, it is possible to suppress wear of the rolling contact surfaces and improve the maintainability. At the same time, since it is possible to keep the load transmission course constant, it is possible to attain a high stability of the mechanism.

4) When a press load works, the flat plate 6 on the side of the arm 3 and the rocker plate 7 on the side of the outer block elastically deform. As a result, when the sector gears 19 and 20 are fixed to the flat plate 6 and the rocker plate 7, a distance between the sector gears 19 and 20 (a distance between pitch circle centers) is reduced and an excessive surface pressure and bending stress occur on the tooth surfaces by a wedge effect.

According to the present embodiment, since the sector gear 20 is supported movably relative to the rocker plate 7, the sector gears are not pressed into each other even if the flat plate 6 and the rocker plate 7 are elastically deformed by the press load, so that the wedge effect does not occur. Therefore, it is possible to avoid an excessive surface pressure and bending stress acting on the tooth faces, whereby the life of the sector gears 19 and 20 can be made longer.

Further, as a method of movably supporting the sector gear 20, a method of parallelly movably supporting the sector gear 20 by a guide member provided with a slide surface, a method of supporting the back side of the sector gear 20 by an elastic member such as rubber, etc., can be taken other than the support by the pin 21. That is, any means can be taken as long as it is a means for allowing the sector gear 20 to move in the direction that the flat plate 6 and the rocker plate 7 elastically deform. Further, although the sector gear 20 on the side of the outer block side 9 is movably supported, it also is sufficient that the sector gear 19 on the side of the arm 3 is movably supported, and both the sector gears 19 and 20 are movably supported.

A second embodiment of the present invention will be explained hereunder, referring to FIG. 8 and FIG. 9.

In FIGS. 8 and 9, in the present embodiment, as a means for holding the sector gear 20 rotatably mounted by the pin 21 at a desired position, a stopper 23 restricting a movement range of the sector gear 20, and an elastic member pressing the sector gear 20 on the stopper, for example, a spring 22 are provided. It also is sufficient to use a hydraulic actuator or a pneumatic actuator, instead of the elastic member 22. That is, any means can be taken as long as it is a means for urging the sector gear 20 to press on the stopper 23.

Inertia caused by reciprocative driving acts on the sector gear 20. By providing the spring 22 and pressing thereby the sector gear 20 on the stopper 23 with a larger force than the inertia, it is possible to exclude an influence of the inertia, so that a relative position of the flat plate 6 and the rocker plate 7 can be further precisely held. Further, even if the flat plate 6 and the rocker plate 7 are elastically deformed by a press load, it is possible to avoid the wedge effect by adjusting an output of the elastic member 22 to a suitable value.

According to the present embodiment, it is possible to further precisely hold a relative position between the flat plate 6 and the rocker plate 7, so that a long life of each of the flat plate 6 and the rocker plate 7 can be realized, at the same time, a high mechanical stability can be attained.

A third embodiment of the present invention will be explained hereunder, referring to FIG. 10 and FIG. 11.

In FIGS. 10 and 11, in the present embodiment, as a means for holding the sector gear 20 rotatably mounted by the pin 21 at a desired position, the stopper 23 restricting the movement range of the sector gear 20 and the spring 22 pressing the sector gear 20 on the stopper 23 are provided, further, as a means for keeping a distance between the sector gears 19 and 20 meshed each other (a distance between pitch circle centers of the sector gears 19 and 20 meshed each other) constant, a third rolling element, for example, a separator 24 is provided. The separator 24 is mounted on the sector gear 20 and moved integrated with the sector gear 20. Further, the separator 24 has the same shape (a flat surface in the case where the rocker plate is a flat plate) as the rolling surface of the rocker plate 7. Further, since a pitch circle radius of the sector gear 20 is the same as a radius of the rolling surface of the rocker plate 7, the separator 24 has the same curvature radius (a flat surface when the sector gear 20 is a rack) as the pitch circle radius of the sector gear 20. Further, the separator is in rolling contact with the flat plate 6.

The elastic member 22 serves a role of pressing the sector gear 20 on the stopper 23 with a force larger than the inertia acting the reciprocative driving. When the flat plate 6 and the rocker plate 7 elastically deform by application of a press load, a force resisting the elastic member 22 occurs between the separator 24 and the flat plate 6, and an output of the elastic member 22 and the press load are not applied on the sector gears 19 and 20. On the other hand, it is found that sticking takes place when gears are used under the condition that there is no backlash.

According to the present embodiment, since it is possible to keep constant a distance between pitch circle centers of the meshed sector gears 19 and 20 by the separator 24, to suppress the wedge effect and the sticking on the tooth surfaces and to realize make the life of each of the sector gears 19, 20 long.

A fourth embodiment of the present invention will be explained hereunder, referring to FIGS. 12 and 13.

In FIGS. 12 and 13, in the present embodiment, a curved surface plate 6A having a shape similar to the rocker plate 7 is used instead of the flat plate 6, and the rolling surfaces of the first and second rolling elements each are made into a concave cylindrical or spherical surface. The other constructions are the same as the third embodiment.

The same effect as one of the third embodiment can be attained by the present embodiment.

In the above, the slab sizing presses each of which one-dimensionally vibrates the dies 14 has been described, the present embodiment can be applied also to an installation in which the dies 14 are vibrated in the slab width direction and the dies 14 given a means for moving them in the slab transferring direction are moved in a circular or arc-shaped locus.

According to the present invention, it is possible to secure the mechanical stability of the sizing press, to make the construction simple, reduce the installation cost and improve the maintainability.

Further, it is possible to avoid an excessive surface pressure or bending stress acting on the gear tooth faces, to realize a long life of the gears and to improve further the maintainability.

What is claimed is:

1. A slab sizing press comprising an eccentric crank shaft, an arm rotatably mounted on said eccentric crank shaft, a first block coupled to said arm by a first rolling element and a second rolling element, a second block coupled to said first block such that a distance between said first block and said second block is adjustable, and a die mounted on said second block, wherein said first rolling element is coupled to said arm, said second rolling element is coupled to said first block, wherein a load is transmitted by rolling contact between said first rolling element and second rolling element, and first and second gears, said first gear disposed on said arm and said second gear disposed on said first block, said first and second gears meshing with each other and said first and second gears preventing said first and second rolling elements from slipping on rolling contact surfaces, at least one of said gears being movably supported.

2. A slab sizing press according to claim 1, further comprising a stopper limiting a movable range of said movably supported gear and a means for urging said movably supported gear to press on said stopper, said stopper and said means for urging holding said movably supported gear at a desired position.

3. A slab sizing press according to claim 2, further comprising a third rolling element integrated and movable with said movably supported gear wherein said third rolling element is made in a same shape as a rolling surface of a rolling element associated with said movably supported gear, said third rolling element contacting an opposing rolling element.

4. A slab sizing press comprising:

an eccentric crank shaft;

an arm rotatably mounted on said eccentric crank shaft;

a first block coupled to said arm by a first rolling element and a second rolling element;

a second block coupled to the first block such that a distance between said first block and said second block is adjustable;

a die mounted on said second block;

said first rolling element coupled to said arm and defining a face disposed toward said first block; and said second rolling element coupled to said first block and effecting rolling contact with said first rolling element, said second rolling element defining a face disposed toward said arm, said rolling contact between said first rolling element and said second rolling element only occurring at said respective faces.

5. The slab sizing press of claim 4 further comprising:

first and second gears, said first gear disposed on said arm and said second gear disposed on said first block, said first and second gears meshing with each other.

6. The slab sizing press of claim 5 wherein at least one of said first and second gears is movably supported.

7. The slab sizing press of claim 6 further comprising a stopper associated with said movably supported gear, said stopper limiting a range of movement of said movably supported gear.

8. The slab sizing press of claim 7 further comprising means for urging said movably supported gear to contact said stopper wherein said stopper and said means for urging hold said movably supported gear at a desired position.

9. A slab sizing press comprising:

an eccentric crank shaft;

an arm rotatably mounted on said eccentric crank shaft;

a first block coupled to said arm by a first rolling element and a second rolling element;

a second block coupled to said first block such that a distance between said first block and said second block is adjustable;

a die mounted on said second block;

said first rolling element coupled to said arm;

said second rolling element coupled to said first block and effecting rolling contact with said first rolling element; and means for stopping slip of said first and second rolling elements on rolling surfaces thereof disposed between said arm and said first block.

10. A slab sizing press comprising:

an eccentric crank shaft;

an arm rotatably mounted on said eccentric crank shaft;

a first block coupled to said arm by a first rolling element and a second rolling element;

a second block coupled to said first block such that a distance between said first block and said second block is adjustable;

a die mounted on said second block;

said first rolling element coupled to said arm;

said second rolling element coupled to said first block and effecting rolling contact with said first rolling element; and a member disposed between said arm and said first block and meshing with said arm and said first block.

11. A slab sizing press comprising:

an eccentric crank shaft;

an arm rotatably mounted on said eccentric crank shaft;

a first block coupled to said arm by a first rolling element and a second rolling element;

a second block coupled to said first block such that a distance between said first block and said second block is adjustable;

a die mounted on said second block;

said first rolling element coupled to said arm;

said second rolling element coupled to said first block and effecting rolling contact with said first rolling element;

first and second members disposed between said arm and said first block and meshing with each other; and a member movably supporting at least one of said first and second members.

12. A sizing press load transmission method comprising the steps:

providing a first block coupled to an arm by a first rolling element and a second rolling element, said arm rotatably mounted to an eccentric crank shaft, and adjusting a distance between said first block and a second block having a die mounted thereon; and contacting said first rolling element with said second rolling element wherein said first rolling element defines a face disposed toward said first block and said second rolling element defines a face disposed toward said arm and wherein said contact between said first rolling element and said second rolling element only occurs at said respective faces.

13. The method of claim 12 further comprising the step of stopping slip of the contact between said first and second rolling elements.

14. The method of claim 13 wherein said step of stopping slip of the contact between said first and second rolling elements includes the step of meshing a first meshing member with a second meshing member, said first meshing member disposed on said arm and said second meshing member disposed on said first block.

15. The method of claim 14 further comprising the step of moving one of said first and second meshing members in a direction of elastic deformation of said first and second rolling elements.

16. A sizing press load transmission method comprising the steps:

providing a first block that transmits a load to and from an arm rotatably mounted on an eccentric crank shaft and adjusting a distance between said first block and a second block having a die mounted thereon;

effecting rolling contact with a first rolling element coupled to said arm and a second rolling element coupled to said first block; and stopping slip of the rolling contact by first and second meshing members, said first meshing member disposed on said arm and said second meshing member disposed on said first block.

17. A sizing press load transmission method comprising the steps:

providing a first block that transmits a load to and from an arm rotatably mounted on an eccentric crank shaft and adjusting a distance between said first block and a second block having a die mounted thereon;

contacting a first rolling element coupled to said arm with a second rolling element coupled to said first block;

stopping slip of the rolling contact between said first rolling element and said second rolling element by first and second meshing members, said first meshing member disposed on said arm and said second meshing member disposed on said first block; and moving one of said first and second meshing members in a direction of elastic deformation of said first and second rolling elements.

* * * * *